US012663219B2

(12) United States Patent
Denoual et al.

(10) Patent No.: US 12,663,219 B2
(45) Date of Patent: Jun. 23, 2026

(54) HEAT EXCHANGER FOR A MOTOR VEHICLE

(71) Applicant: VALEO SYSTEMES THERMIQUES, Le Mesnil-Saint-Denis (FR)

(72) Inventors: Christophe Denoual, Le Mesnil-Saint-Denis (FR); Roberto Fernandez, Saragossa (ES); Jingyu Ni, Shashi (CN)

(73) Assignee: Valeo Systemes Thermiques, Le Mesnil-Saint-Denis (FR)

( * ) Notice: Subject to any disclaimer, the term of this patent is extended or adjusted under 35 U.S.C. 154(b) by 106 days.

(21) Appl. No.: 18/715,732

(22) PCT Filed: Nov. 29, 2022

(86) PCT No.: PCT/EP2022/083734
§ 371 (c)(1),
(2) Date: Jun. 3, 2024

(87) PCT Pub. No.: WO2023/104594
PCT Pub. Date: Jun. 15, 2023

(65) Prior Publication Data

US 2025/0052505 A1 Feb. 13, 2025

(30) Foreign Application Priority Data

Dec. 8, 2021 (FR) ..... 2113112

(51) Int. Cl.
*F28F 9/02* (2006.01)
*F28D 9/00* (2006.01)

(52) U.S. Cl.
CPC ..... *F28D 9/005* (2013.01); *F28D 9/0037* (2013.01); *F28F 9/0202* (2013.01)

(58) Field of Classification Search
CPC ..... F28D 9/0037; F28D 9/0043; F28D 9/005; F28D 2021/0028; F28D 2021/008; F28F 9/0202
See application file for complete search history.

(56) References Cited

U.S. PATENT DOCUMENTS 5,462,113 A 10/1995 Wand
5,971,065 A * 10/1999 Bertilson ..... F28F 3/083 165/166

(Continued)

FOREIGN PATENT DOCUMENTS

CA 2504533 A1 10/2006
DE 102018206574 A1 10/2019

(Continued)

OTHER PUBLICATIONS

International Search Report issued in corresponding International Application No. PCT/EP2022/083734 mailed Mar. 14, 2023 (6 pages).

(Continued)

*Primary Examiner* — Eric S Ruppert
*Assistant Examiner* — Hans R Weiland
(74) *Attorney, Agent, or Firm* — Osha Bergman Watanabe & Burton LLP

(57) ABSTRACT

A heat exchanger for a vehicle includes a plurality of plates is disclosed. The plates are stacked one on top of the other in a stacking direction to form a bundle of plates. At least one first plate and at least one second plate define a first circulation path that is configured for circulation of a first fluid. At least the second plate and at least one third plate define a second circulation path that is configured for circulation of a second fluid. The bundle of plates includes a first distribution chamber that is configured to supply the first circulation path with first fluid. The first plate has a through-hole surrounded by a plateau. The through-hole is (Continued)

Figure 1:
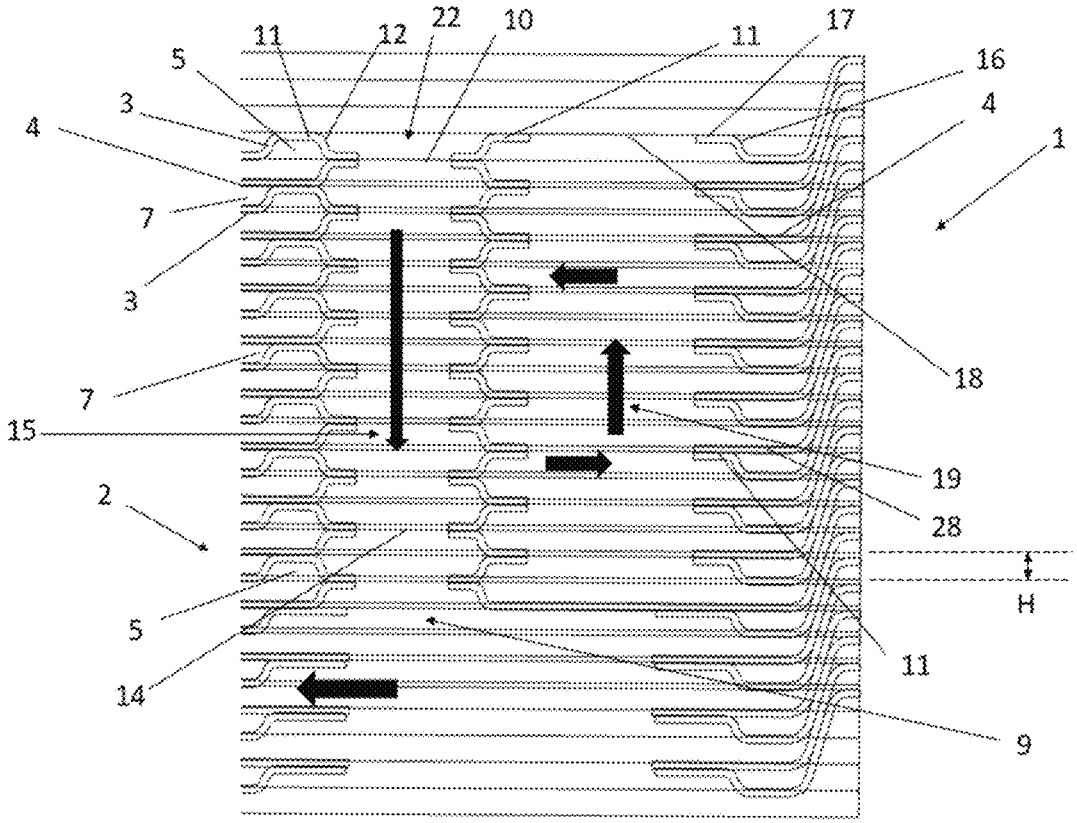

surrounded by an internal raised edge. The internal raised edge is of a substantially annular shape. The plateau includes, on its top, an orifice belonging to a return passage.

11 Claims, 5 Drawing Sheets

(56) References Cited

U.S. PATENT DOCUMENTS

| | | | | |
|---|---|---|---|---|
| 11,289,752 | B2 * | 3/2022 | Shisler | F28F 3/025 |
| 2003/0106679 | A1 * | 6/2003 | Brost | F28D 9/005 165/154 |
| 2005/0211421 | A1 * | 9/2005 | Ekelund | F28D 9/005 165/114 |
| 2013/0061630 | A1 * | 3/2013 | Schaefer | F28D 9/005 62/502 |
| 2013/0126137 | A1 * | 5/2013 | Velte | F28D 1/0333 165/167 |
| 2018/0328672 | A1 * | 11/2018 | Balasus | F28F 3/10 |
| 2019/0331436 | A1 * | 10/2019 | Dolderer | F28D 9/0043 |
| 2022/0099381 | A1 * | 3/2022 | Pelletier | F28F 9/0265 |

FOREIGN PATENT DOCUMENTS

| | | | |
|---|---|---|---|
| FR | 2986315 | A1 | 8/2013 |
| WO | 98/35770 | A1 | 8/1998 |
| WO | 2017/136707 | A1 | 8/2017 |

OTHER PUBLICATIONS

Written Opinion issued in corresponding International Application No. PCT/EP2022/083734 mailed Mar. 14, 2023 (5 pages).

* cited by examiner

HEAT EXCHANGER FOR A MOTOR VEHICLE

The present invention relates to a heat exchanger for a motor vehicle.

The vehicle may be a land vehicle, marine vehicle or air vehicle.

The present invention relates in particular to the field of heat exchangers, in particular those intended to equip air-conditioning systems and/or cooling systems of motor vehicles. More particularly, the invention relates to systems for cooling electrical storage devices, in particular batteries, of motor vehicles.

A heat exchanger comprising a plurality of elongate plates stacked one on top of the other, between which cavities are formed, is known. Two fluids circulate in the superposed cavities—a coolant and a fluid to be cooled—so that heat can be exchanged between the two fluids. Openings are usually provided in the plates, openings that coincide to form a total of four channels or chambers perpendicular to the stacked plates. Two of these channels are intended to supply and discharge one fluid and two of these channels are intended to supply and discharge the other fluid to and from the respective cavities. The cavities for the two fluids alternate in the heat exchanger and the channels are fluidically connected only to the corresponding cavities.

In order to be able to implement certain fluid path layouts in the stacked-plate heat exchanger, for example a path with multiple passes, a dip tube, which guides the fluid through the stacked plates, is required.

Patent application DE102018206574A1 describes a plate exchanger that makes provision for the dip tube as an additional component to be replaced with a channel that is functionally identical but is formed by the plates themselves.

The present invention aims to improve this known exchanger.

One subject of the invention is thus a heat exchanger, in particular for a vehicle, comprising a plurality of plates, the plates being stacked one on top of the other in a stacking direction to form a bundle of plates, at least one first plate and at least one second plate define a first circulation path that is configured for circulation of a first fluid, at least the second plate and at least one third plate define a second circulation path that is configured for circulation of a second fluid, the bundle of plates comprising a first distribution chamber that is configured to supply the first circulation path with first fluid, characterized in that the first plate has a through-hole surrounded by a plateau, this hole being surrounded by an internal raised edge of the plateau, this edge having a substantially annular shape so as to form, with the hole, a section of a dip channel that is arranged so as to conduct the first fluid toward the first distribution chamber, this plateau further comprising an external raised edge, the external raised edge of the plateau surrounding its internal raised edge, the plateau also comprising, on its top, an orifice belonging to a return passage of the first circulation path, this orifice being between the internal and external raised edges of the plateau, the distance between the internal edge and the external edge of the plateau widening in a region in which the orifice is present.

The stack of plates forms a succession of dip channel sections that, together, form a complete dip channel.

The present invention presents improvements to the aspect of the pressure drop since the dip channel and/or the orifices of the return passage are not completely surrounded by an annular bead, said bead resulting in a non-optimal pressure drop.

Furthermore, the present invention makes it possible to avoid having a multitude of holes around the dip channel and provides, for each plate, a single return-passage orifice. This also makes it possible to improve the pressure drop.

According to one of the aspects of the invention, provision is made for a second distribution chamber that is configured to supply the second circulation path with second fluid.

According to one of the aspects of the invention, the top of the plateau is planar and the orifice of the return passage is also planar.

According to one of the aspects of the invention, the orifice of the return passage and the through-hole of the first plate extend along two parallel planes that are separated from one another by a non-zero height.

According to one of the aspects of the invention, for one of the plates, in particular for all of the plates, the surface area of the through-hole is smaller than the surface area of the orifice of the return passage.

In one variant, the surface area of the through-hole is larger than the surface area of the orifice of the return passage.

In another variant, the surface area of the through-hole is equal to the surface area of the orifice of the return passage.

According to one of the aspects of the invention, a single return-passage orifice for the first fluid path is provided in each first plate.

This avoids having multiple return-passage orifices in the plate.

According to one of the aspects of the invention, the return-passage orifice has a shape that faces only a portion of the contour of the associated through-hole.

In other words, the orifice of the return passage does not completely surround the through-hole.

According to one of the aspects of the invention, the dip channel is arranged so as to conduct the first fluid from a first fluid inlet to the distribution chamber that is substantially opposite the fluid inlet, in the direction of the stack of plates.

According to one of the aspects of the invention, the dip channel is formed by at least half of the stacked plates, in particular approximately 55% to 80% of the plates.

According to one of the aspects of the invention, the dip channel is formed by a succession of through-holes and of annular raised edges that are associated with these holes and aligned with one another.

According to one of the aspects of the invention, the second plate comprises a plateau on the top of which one of the through-holes of the dip channel is formed, and this plateau of the second plate comes to bear against the first plate such that the through-holes of these two plates are aligned.

Each through-hole thus faces a point of contact between two perforated planar zones of two adjacent plates.

According to one of the aspects of the invention, the orifice of the return passage in the second plate is formed in a planar zone of this second plate that is connected to the plateau via a raised edge.

According to one of the aspects of the invention, this planar zone of the second plate is in contact with a plateau of the adjacent plate, and the orifices of these adjacent plates are aligned with respect to one another.

According to one of the aspects of the invention, the return passage for the first fluid and the dip channel extend in a parallel manner.

According to one of the aspects of the invention, the return passage of the first fluid path extends at least partially around each through-hole of the dip channel.

According to one of the aspects of the invention, the through-hole has a contour that is substantially in the form of a portion of a circle and optionally a straight edge.

According to one of the aspects of the invention, the through-hole has a substantially circular contour.

According to one of the aspects of the invention, the orifice of the return passage has a contour that is substantially in the form of a portion of a circle and optionally a straight edge.

According to one of the aspects of the invention, the orifice of the return passage has a substantially circular contour.

According to one of the aspects of the invention, the orifice of the return passage has a crescent-moon shape.

According to one of the aspects of the invention, the through-hole and the orifice of the return passage each have a contour that is substantially in the form of a portion of a circle and a straight edge, the respective straight edges being parallel and facing one another.

According to one of the aspects of the invention, the through-hole has a circular contour and the orifice of the return passage has a crescent-moon shape that partially surrounds the through-hole.

According to one of the aspects of the invention, the first fluid path, on account of the return passage, has at least one reversal, so as to create a path with at least two passes.

According to one of the aspects of the invention, the first fluid path, on account of the return passage, has at least two reversals, so as to create a path with at least three passes.

The heat exchanger according to the invention may be used in a cooling system, in particular for cooling cells of an electric battery.

Another subject of the invention is a plate for a heat exchanger, in particular for a vehicle, this plate being arranged so as to define, with an adjacent plate, a first circulation path that is configured for circulation of a first fluid, characterized in that the first plate has a through-hole surrounded by a plateau, this hole being surrounded by an internal raised edge of the plateau, this edge having a substantially annular shape so as to form, with the hole, a section of a dip channel that is arranged so as to conduct the first fluid toward a first distribution chamber, this plateau further comprising an external raised edge, the external raised edge of the plateau surrounding its internal raised edge, the plateau also comprising, on its top, an orifice belonging to a return passage of the first circulation path, this orifice being between the internal and external raised edges of the plateau, the distance between the internal edge and the external edge of the plateau widening in a region in which the orifice is present.

Figure 2:
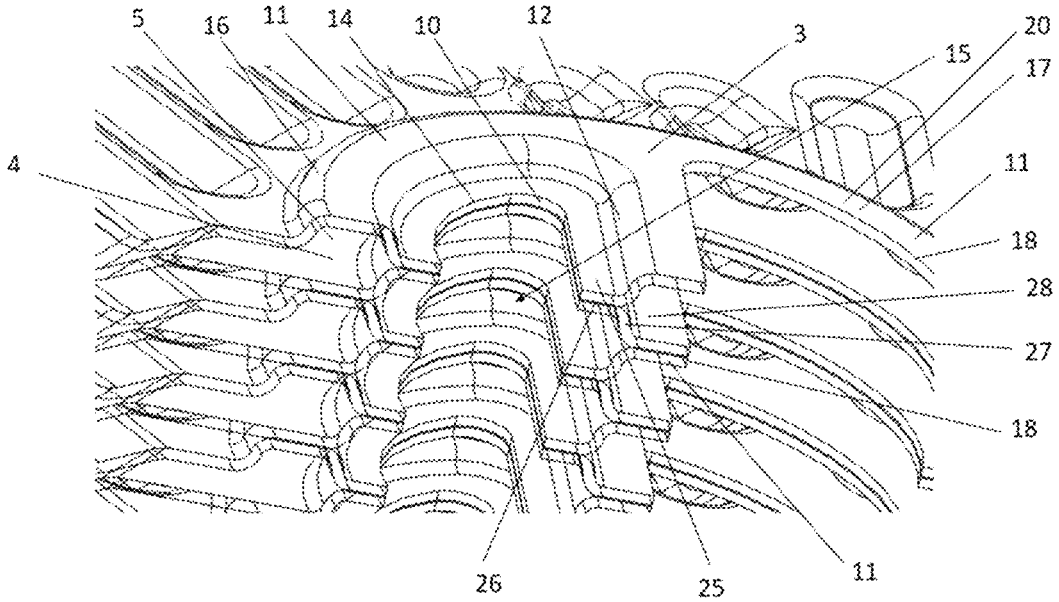
Figure 3:
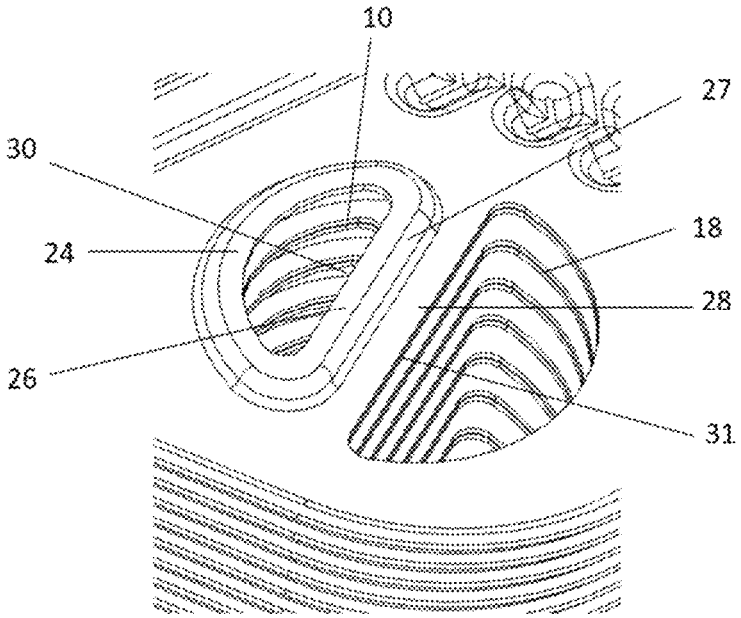
Figure 4:
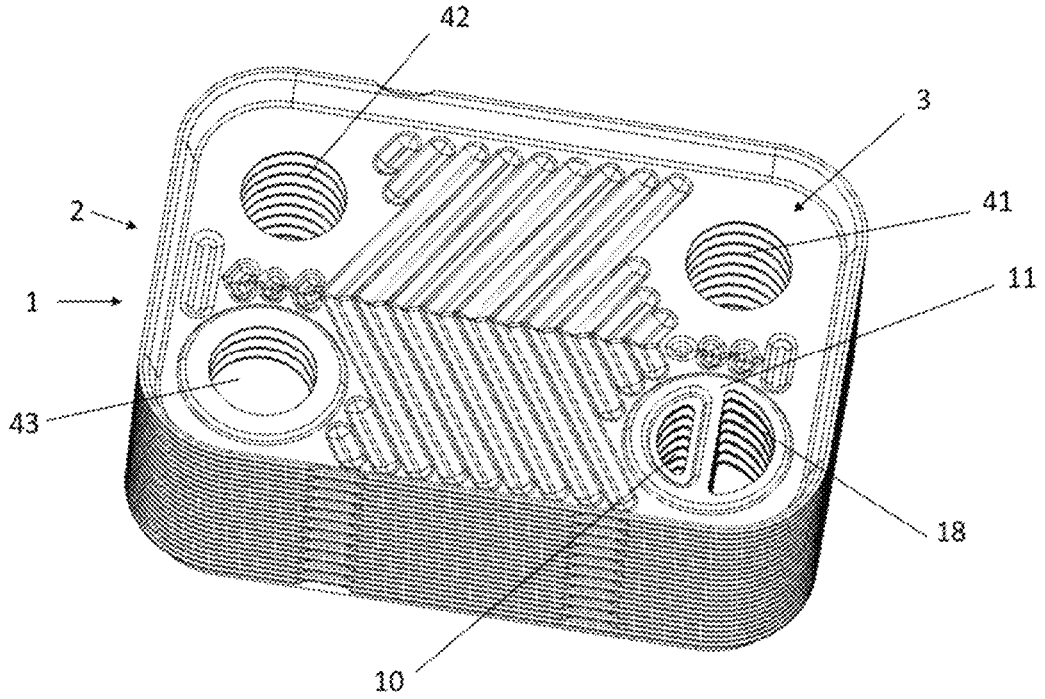
Figure 5:
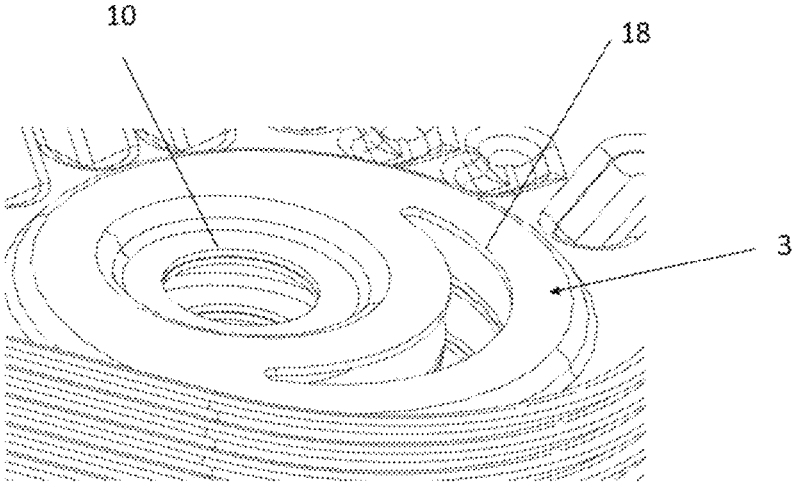

Further features and advantages of the invention will become more clearly apparent upon reading the following description, which is given by way of illustrative and non-limiting examples, and from the appended drawings, in which:

FIG. 1 schematically and partially illustrates, in cross section, a heat exchanger according to one exemplary embodiment of the invention, FIG. 2 schematically and partially illustrates a detail of the exchanger from FIG. 1, FIG. 3 schematically and partially illustrates another view of the part from FIG. 2, FIG. 4 schematically and partially illustrates a stack of plates of the exchanger from FIG. 1, FIG. 5 schematically and partially illustrates another exemplary embodiment of the invention.

FIG. 1 shows a heat exchanger 1 for a motor vehicle, comprising a plurality of plates, the plates being stacked one on top of the other in a stacking direction to form a bundle 2 of plates.

Of these plates, a first plate 3 and a second plate 4 define a first circulation path 5 that is configured for circulation of a first fluid.

The second plate 4 and a third plate, which is identical to the first plate 3, define a second circulation path 7 that is configured for circulation of a second fluid.

The bundle 2 of plates comprises a first distribution chamber 9 that is configured to supply the first circulation path 5 with first fluid and a second distribution chamber (not shown) that is configured to supply the second circulation path 7 with second fluid.

The first plate 3 has a through-hole 10 surrounded by a plateau 11, this hole 10 being surrounded by an internal raised edge 12 of the plateau 11.

This internal edge 12 has a substantially annular shape so as to form, with the hole 10, a section 14 of a dip channel 15 that is arranged so as to conduct the first fluid toward the first distribution chamber 9, as can be seen in FIGS. 1 and 2.

This plateau 11 further comprises an external raised edge 16, the external raised edge 16 of the plateau surrounding its internal raised edge 12.

The plateau 11 also comprises, on its top 17, an orifice 18 belonging to a return passage 19 of the first circulation path 5.

This orifice 18 is between the internal 12 and external 16 raised edges of the plateau 11, the distance between the internal edge 12 and the external edge 16 of the plateau widening in a region 20 in which the orifice 18 is present.

The stack of plates 3 and 4 forms a succession of dip channel sections 14 that, together, form the complete dip channel 15.

The top 17 of the plateau is planar and the orifice 18 of the return passage is also planar.

The orifice 18 of the return passage and the through-hole 10 of the first plate 3 extend along two parallel planes that are separated from one another by a non-zero height H.

The surface area of the through-holes 10 is smaller than the surface area of the orifices 18 of the return passage.

A single return-passage orifice 18 for the first fluid path 5 is provided in each first plate 3.

This avoids having multiple return-passage orifices in the plate.

The return-passage orifice 18 has a shape that faces only a portion of the contour of the associated through-hole.

In other words, the orifice 18 of the return passage does not completely surround the through-hole 10, as can be clearly seen in FIG. 3.

The dip channel 15 is arranged so as to conduct the first fluid from a first fluid inlet 22 to the distribution chamber 9 that is substantially opposite the fluid inlet, in the direction of the stack of plates 3 and 4.

The dip channel 15 is formed by at least half of the stacked plates, in particular by 55% to 80% of the stacked plates 3 and 4.

The plates 3 and 4 alternate, specifically one plate 3 being between two plates 4 and so on.

The dip channel 15 is formed by a succession of through-holes 10 and of annular raised edges 12 that are associated with these holes 10 and aligned with one another.

The second plate 4 comprises a plateau 24 on the top 17 of which the through-hole 10 of the dip channel 15 is formed, and this plateau 24 of the second plate 4 comes to bear against the first plate 3 such that the through-holes 10 of these two plates are aligned.

Each through-hole 10 faces a point of contact between two perforated planar zones 25 and 26 of two adjacent plates 3 and 4.

The orifice 18 of the return passage in the second plate 4 is formed in a planar zone 28 of this second plate that is connected to the plateau 24 via a raised edge 27, as can be more clearly seen in FIG. 3.

This planar zone 28 of the second plate 4 is in contact with the plateau 11 of the adjacent plate, and the orifices 18 of these adjacent plates are aligned with respect to one another.

The return passage 19 for the first fluid and the dip channel 15 extend in a parallel manner.

The return passage 19 of the first fluid path 5 extends at least partially around each through-hole 10 of the dip channel 15.

The through-hole 10 has a contour that is substantially in the form of a portion of a circle and optionally a straight edge.

The through-hole 10 and the orifice 18 of the return passage each have a contour that is substantially in the form of a portion of a circle and a straight edge, the respective straight edges 30 and 31 being parallel and facing one another.

FIG. 4 illustrates the first plate 3 on the top of the stack of plates for forming the bundle 2. Three other inlet or outlet orifices of the fluid paths are provided, and are referenced 41, 42 and 43.

In another example illustrated in FIG. 5, the through-hole 10 has a circular contour and the orifice 18 of the return passage has a crescent-moon shape that partially surrounds the through-hole.

The first fluid path 5, on account of the return passage 19, has at least two reversals, so as to create a path with at least three passes.

The heat exchanger 1 according to the invention may be used in a cooling system, in particular for cooling cells of an electric battery.

This exchanger 1 could also be employed to cool and/or heat other components located in a motor vehicle.

The heat exchanger 1 according to the invention may be used in a cooling system, in particular for cooling cells of an electric battery. This exchanger 1 is arranged in a cooling system comprising a loop thermally coupled to the electrical storage device and in communication with a first path 5 of the heat exchanger 1, and a circuit in communication with a second circulation path of the heat exchanger 1.

The heat exchanger implements an exchange of heat energy between a first fluid and a second fluid, the first fluid then being cooled by the second fluid. The first fluid is, for example, a heat-transfer fluid or a mixture of one or more heat-transfer fluids and one or more other fluids.

One of the fluids may be a dielectric fluid.

The other fluid may be a refrigerant or a mixture of one or more refrigerants and one or more other fluids. The refrigerant or refrigerants are in particular refrigerant liquids from the family of the hydrochlorofluorocarbons (HCFCs) or of the hydrofluorocarbons. The refrigerant liquid may in particular be R134a, known under the name 1,1,1,2-tetrafluoroethane, or 1234YF, also known as 2,3,3,3-tetrafluoropropene. The refrigerant liquid may also be carbon dioxide, known under the reference R744.

The invention claimed is:

1. A heat exchanger for a vehicle, the heat exchanger comprising:

a plurality of plates, wherein the plates are stacked one on top of the other in a stacking direction to form a bundle of plates, wherein at least one first plate and at least one second plate of the plurality of plates define a first circulation path that is configured for circulation of a first fluid, wherein at least the second plate and at least one third plate define a second circulation path that is configured for circulation of a second fluid, the bundle of plates comprising a first distribution chamber that is configured to supply the first circulation path with first fluid, wherein the first plate has a through-hole surrounded by a plateau, wherein the through-hole is surrounded by an internal raised edge of the plateau, wherein the internal raised edge is of a substantially annular shape so as to form, with the hole, a section of a dip channel that is arranged so as to conduct the first fluid toward the first distribution chamber, the plateau further comprising:

an external raised edge, wherein the external raised edge of the plateau surrounds its internal raised edge, and on its top, an orifice belonging to a return passage of the first circulation path, wherein the orifice is between the internal and external raised edges of the plateau, the distance between the internal edge and the external edge of the plateau widening in a region in which the orifice is present.

2. The exchanger as claimed in claim 1, wherein the top of the plateau is planar and the orifice of the return passage is also planar.

3. The exchanger as claimed in claim 1, wherein the surface area of the through-hole of the dip channel is smaller than the surface area of the orifice of the return passage.

4. The exchanger as claimed in claim 1, wherein a single return-passage orifice for the first fluid path is provided in each first plate.

5. The exchanger as claimed in claim 1, wherein the return-passage orifice is of a shape that faces only a portion of the contour of the associated through-hole.

6. The exchanger as claimed in claim 1, wherein the dip channel is arranged so as to conduct the first fluid from a first fluid inlet to a distribution chamber that is substantially opposite the fluid inlet.

7. The exchanger as claimed in claim 1, wherein the second plate comprises a plateau on the top of which one of the through-holes of the dip channel is formed, and wherein the plateau of the second plate comes to bear against the first plate such that the through-holes of these two plates are aligned.

8. The exchanger as claimed in claim 1, wherein the orifice of the return passage has a contour that is substantially in the form of a portion of a circle and optionally a straight edge.

9. The exchanger as claimed in claim 1, wherein the orifice of the return passage has a crescent-moon shape.

10. The exchanger as claimed in claim 1, wherein the first fluid path, on account of the return passage, comprises at least two reversals, so as to create a path with at least three passes.

11. A plate for a heat exchanger for a vehicle, wherein the plate is arranged so as to define, with an adjacent plate, a first circulation path that is configured for circulation of a first fluid, wherein the plate has a through-hole surrounded by a plateau, wherein the through-hole is surrounded by an internal raised edge of the plateau, wherein the internal raised edge edge is of a substantially annular shape so as to form, with the hole, a section of a dip channel that is arranged so as to conduct the first fluid toward a first distribution chamber, the plateau further comprising:

an external raised edge, wherein the external raised edge of the plateau surrounds its internal raised edge, and on its top, an orifice belonging to a return passage of the first circulation path, wherein the orifice is between the internal and external raised edges of the plateau, the distance between the internal edge and the external edge of the plateau widening in a region in which the orifice is present.

* * * * *